US005467788A

United States Patent [19]

Kimura

[11] Patent Number: 5,467,788

[45] Date of Patent: Nov. 21, 1995

[54] HAIR CURLER AND METHOD OF MANUFACTURING THE SAME

[75] Inventor: Yoshio Kimura, Osaka, Japan

[73] Assignee: Lucky Corporation Co., Ltd., Osaka, Japan

[21] Appl. No.: 254,916

[22] Filed: Jun. 6, 1994

[30] Foreign Application Priority Data

Aug. 25, 1993 [JP] Japan ..... 5-210545

[51] Int. Cl.[6] ..... A45D 2/00; A45D 6/14

[52] U.S. Cl. ..... 132/255; 132/254

[58] Field of Search ..... 132/200, 226, 132/245, 253, 254, 255, 260

[56] References Cited

U.S. PATENT DOCUMENTS

| | | | |
|---|---|---|---|
| 582,563 | 5/1897 | Wegefarth | 132/255 |
| 3,354,889 | 11/1967 | Zeman | 132/260 |
| 3,464,426 | 9/1969 | Packer | 132/226 X |
| 3,500,837 | 3/1970 | Ferens | 132/253 |
| 4,056,109 | 11/1977 | Takai | 132/255 X |
| 4,630,622 | 12/1986 | Foreman | 132/253 |

FOREIGN PATENT DOCUMENTS 5-16961 5/1993 Japan .

*Primary Examiner*—John G. Weiss

*Attorney, Agent, or Firm*—Oblon, Spivak, McClelland, Maier & Neustadt

[57] ABSTRACT

The present invention facilitates visually checking whether or not either end of a cover has been fixedly embedded, by insert molding, properly in a pair of clasps of a setting frame. In a hair curler of the present invention, the outer edge at either end of the cover is fixedly embedded in the pair of clasps, exposed out of the outer side surface of the pair of clasps. According to the method of manufacturing the hair curler of the present invention, the projecting portion with the outer edge side of the cover embedded, in the insert molding of the setting frame, is integrally formed on the outside surface of the pair of clasps, and then is cut off from the pair of clasps together with the outer edge side of the cover embedded in the projecting portion.

12 Claims, 12 Drawing Sheets

HAIR CURLER AND METHOD OF MANUFACTURING THE SAME

FIELD OF THE INVENTION AND RELATED ART STATEMENT

The present invention relates to a hair curler for curling a strand of hair and a method of manufacturing the hair curler.

A conventional hair curler, as shown in FIGS. 16 and 17, is provided with a roller 1, and a longitudinal, frame-like setting frame 3 having a pair of clasps 2 for radially holding the roller 1 from both sides; the setting frame 3 has a flexible cover 4 which is releasably engaged with either end in an axial direction of the roller 1, and covers over a nearly entire length of about a half of the outer periphery of the roller between the clasps 2, 2; and either end 4A of the cover 4 is fixedly embedded by insert molding in the pair of clasps 2 of the setting frame 3 (Japanese Utility Model Laid-Open No. Hei 5-16961).

In this type of hair curler, however, either end 4A of the cover 4 is likely to come off from the pair of clasps 2 during insert molding of the setting frame 3. It is, therefore, feared that the fixedly embedding of either end 4A in the setting frame 3 is not done well. In the conventional type, it can not visually be checked easily whether or not either end 4A of the cover 4 has been fixedly embedded properly in the pair of clasps 2 of the setting frame 3, and therefore it is very difficult to see whether or not the hair curler is defective.

Furthermore, in insert-molding the setting frame 3 in an attempt to insure the fixedly embedding of either end 4A of the cover 4 in the setting frame 3, if either end 4A is embedded in the clasp 2 with the outer edge side of either end 4A protruding outwardly from the outside surface of the pair of clasps 2, 2 as shown in FIG. 18, it will become difficult to cut clean the outer edge side of either end 4A protruding outwardly from the outside surface of the clasp 2 because of flexibility of the cover 4.

OBJECT AND SUMMARY OF THE INVENTION

It is, therefore, an object of the present invention to facilitate visual ascertainment of proper fixedly embedding, by insert-molding, of either end of the cover in a pair of clasps of a setting frame. And, it is another object of the present invention to facilitate clean cutting of the outer edge side of the cover outwardly protruding from the outside surface of the clasp.

In an attempt to accomplish the above objects, the hair curler of the present invention has a roller and a rectangular frame-like setting frame having a pair of clasps for holding the roller radially from both sides; the setting frame is releasably engaged axially with either end of the roller and is provided with a flexible cover covering the nearly entire length of about a half of the outer periphery of the roller between the clasps; and both ends of the cover are fixedly embedded by insert molding in the pair of clasps of the setting frame.

In this hair curler, the outer edges at both ends of the cover are fixedly embedded in the pair of clasps, exposed out of the outer side surface of the pair of clasps.

Also, a method of manufacturing the hair curler of the present invention, which includes the roller, and a rectangular frame-like setting frame with a pair of clasps for holding the roller radially from both sides, the setting frame being releasably engaged with either end in axial direction of the roller, the flexible cover being provided for covering the entire length of about a half of the outer periphery of the roller between the clasps, and either end of the cover being fixedly embedded by insert molding to the pair of clasps of the setting frame; the method comprises the steps of integrally forming a projecting portion with the outer edge side of the cover embedded in the outer side surface of the pair of clasps, and thereafter cutting the projecting portion from the pair of clasps together with the outer edge side of the cover embedded in the projecting burr portion.

Therefore, in molding the setting frame, the cover is preset inside molds and as shown in FIGS. 9 and 10, for molding the setting frame by an insert-molding method. At this time, the projecting portion with the outer edge side of the cover is integrally formed with the outer side surface of the pair of clasp sections as shown in FIG. 11. Subsequently, as shown in FIG. 12, the projecting portion is cut off from the pair of clasps together with the outer edge side of the cover embedded in the projecting portion. At this time, the outer edge of either end of the cover is exposed out of the outside surface of the pair of clasps, serving as a mark for ascertaining the proper fixedly embedding of either end of the cover in the pair of clasps.

According to the present invention, since the outer edge of either end portion of the cover is exposed out of the outer side surface of the pair of clasps and serves as a mark for ascertaining the fixedly embedding of the pair of clasps, it is possible to visually ascertain very easily whether or not either end of the cover has been properly fixedly embedded in the pair of clasps of the setting frame, and accordingly the quality of hair curlers thus manufactured can be checked very easily.

Furthermore, in the insert molding of the setting frame, the projecting portion with the outer edge side of the cover embedded is integrally formed on the outer side surface of the pair of clasps, and then is cut off from the pair of clasps. Therefore, the outer edge side of either end protruding outwardly from the outside surface of the clasp can be easily cut clean together with the projecting portion. Moreover, the outer edge of either end portion of the cover is exposed out of the outside surface of the pair of clasp portion, becoming a mark for ascertaining the fixedly embedding of the edge of either end portion in the pair of clasps. Therefore there is no necessity of particularly providing the mark.

DETAILED DESCRIPTION OF PREFERRED EMBODIMENT

Figure 1:
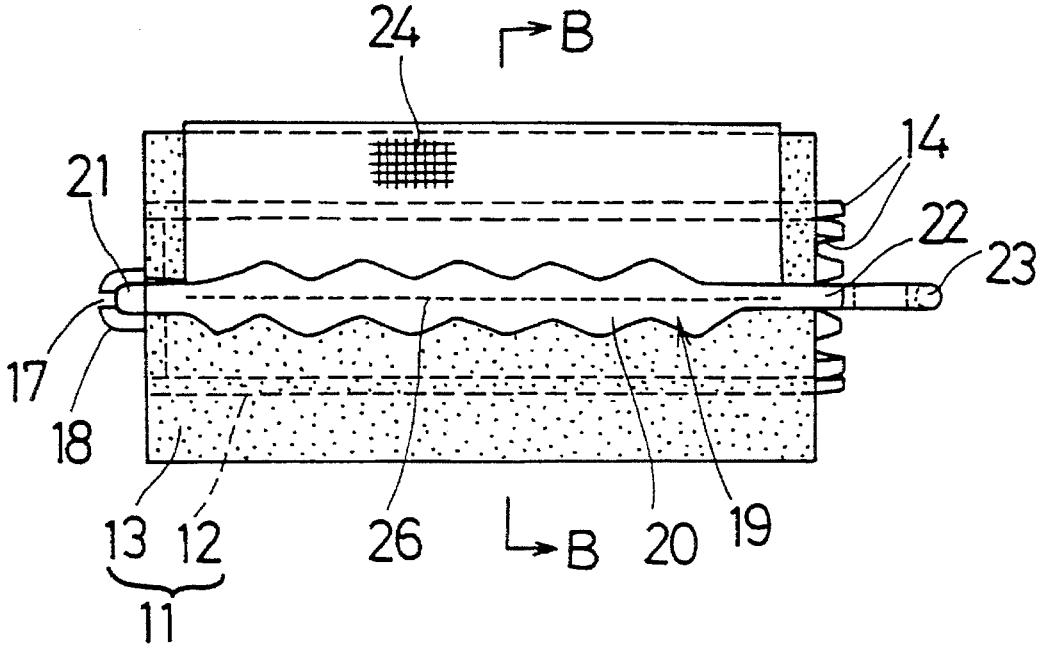
FIG. 1 is a front view showing one embodiment of a hair curler according to the present invention.
Figure 2:
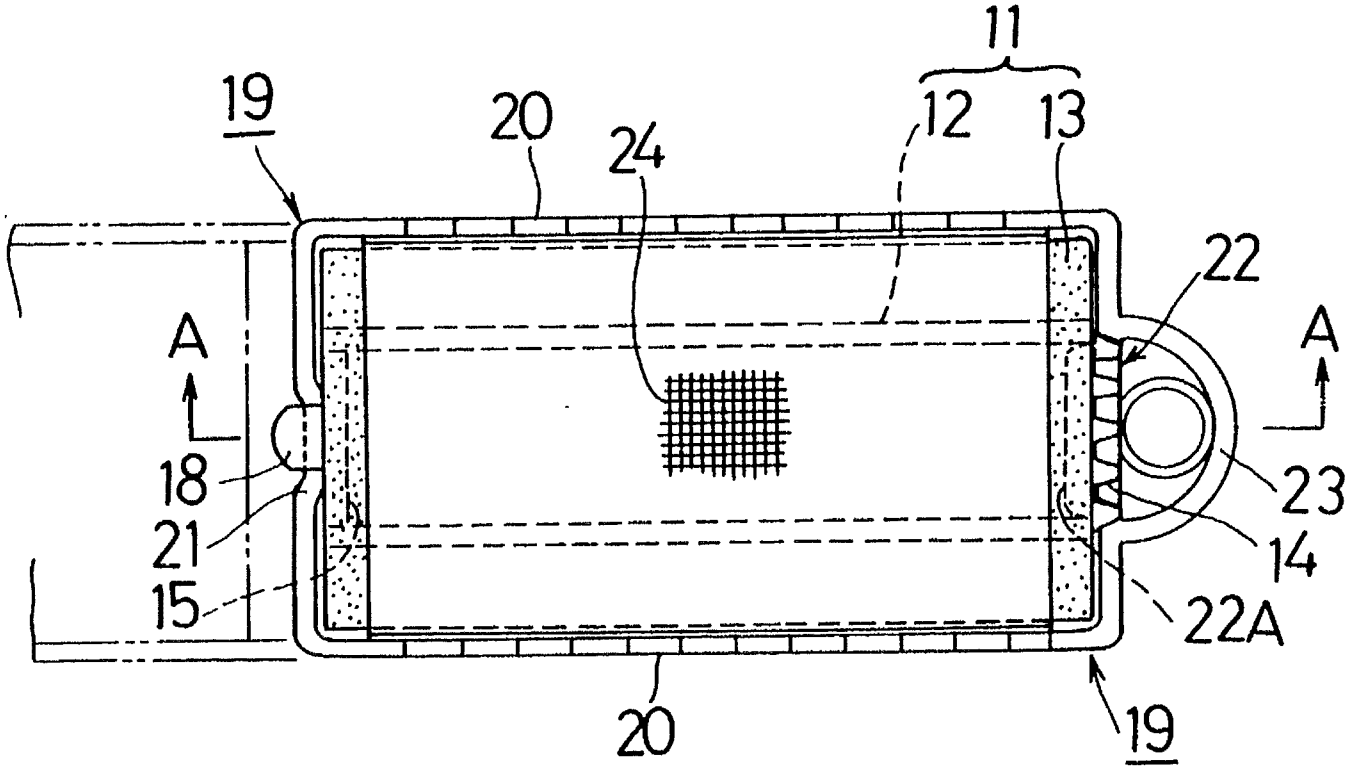
FIG. 2 is a plan view.
Figure 3:
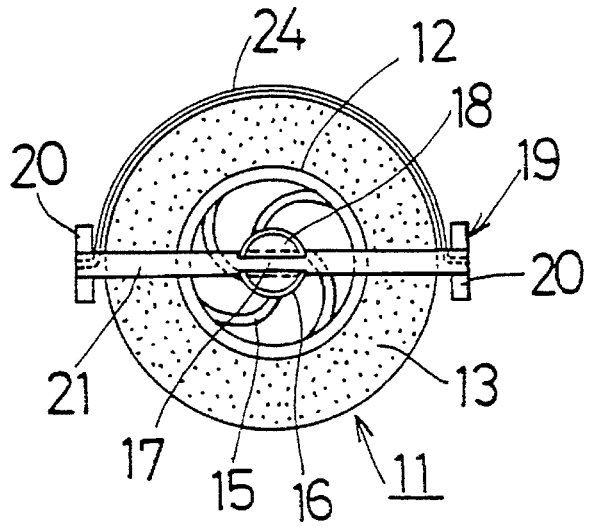
FIG. 3 is a left side view.
Figure 4:
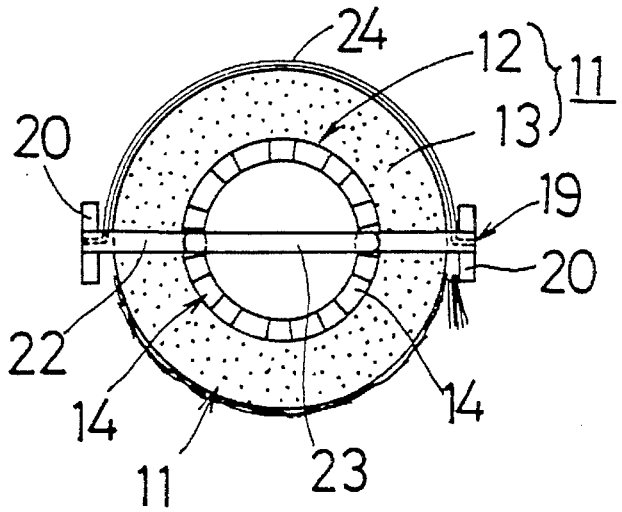
FIG. 4 is a right side view.
Figure 5:
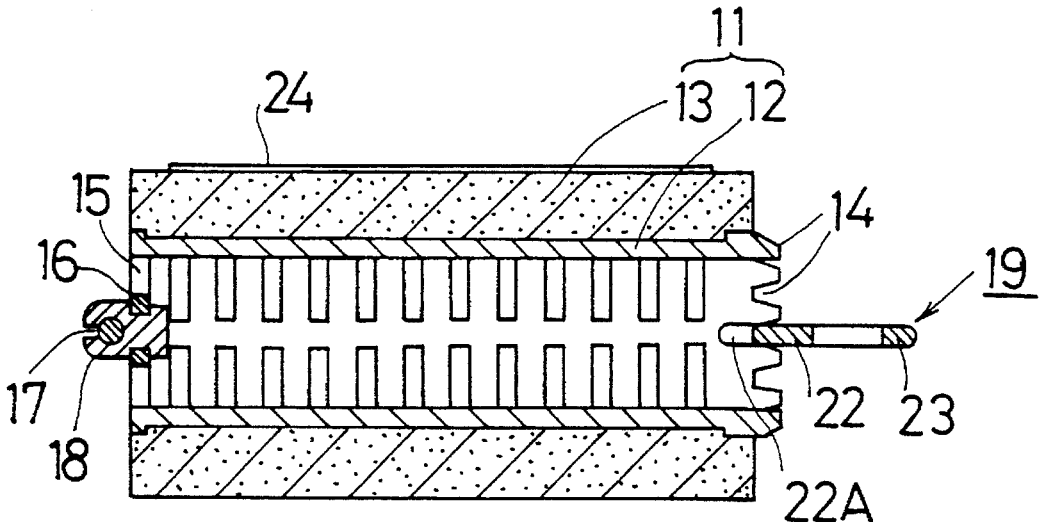
FIG. 5 is a sectional view taken along line A—A of FIG. 2.
Figure 6:
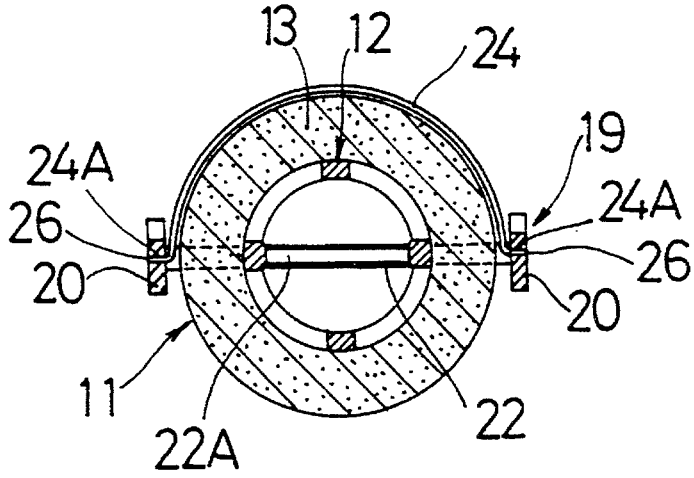
FIG. 6 is a sectional view taken along line B—B of FIG. 1.
Figure 7:
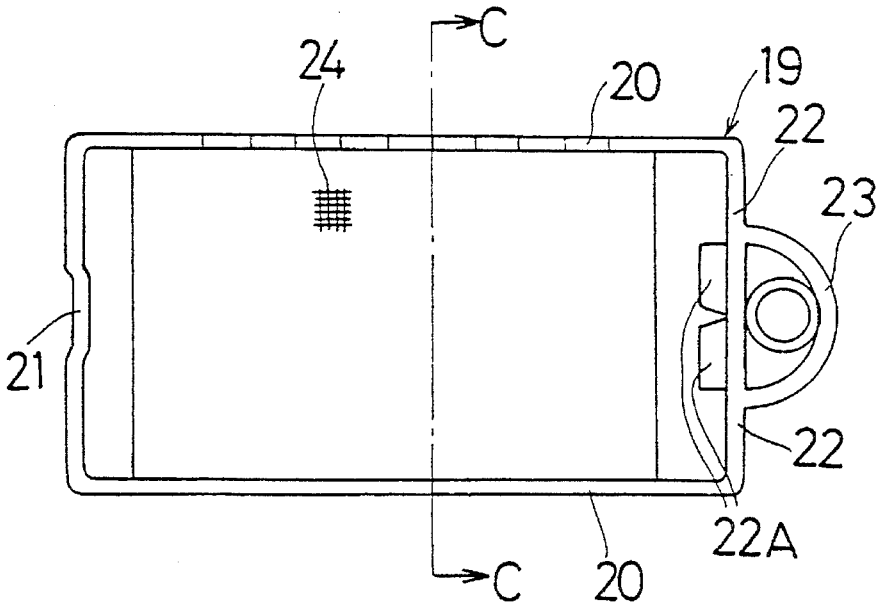
FIG. 7 is a plan view of a setting frame fixedly attached with a cover.
Figure 8:
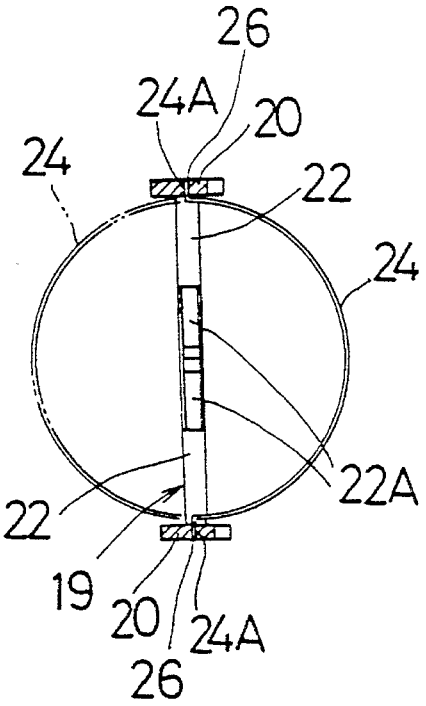
FIG. 8 is a sectional view taken along line C—C of FIG. 7.

Hereinafter an embodiment of a hair curler according to the present invention will be explained with reference to the accompanying drawings. In FIGS. 1 to 8, a reference numeral 11 refers to a roller, which comprises a core cylinder 12 produced of synthetic resin in a cage-type cylindrical form, and an outer skin part 13 produced of foamed synthetic resin fitted on the outside surface of the core cylinder 12. On one end of the core cylinder 12 is formed a setting frame engaging portion 14 of a tooth form; and on the other end is rotatably installed a synthetic-resin setting frame lock 18 having a bifurcated engaging section 17 at the boss 16 through a plurality of arms 15. In the example illustrated, the roller 11 comprises the core cylinder 12 and the outer skin part 13, but it should be noted that the roller 11 is not limited thereto and may be of any constitution if it is of a roll type, for example a roller integrally formed of a relatively soft material.

A reference numeral 19 denotes a setting frame produced of synthetic resin, for example, polyethylene resin, which is formed in a rectangular configuration of a pair of waved clasps 20 holding the roller 11 radially from both outer sides, and engaging parts 21 and 22 connecting opposite ends of the clasps 20. One engaging part 22 has engaging lugs 22A at center inside, which fit to engage in the core cylinder 12. On the outside of the lugs 22A is protrusively formed a finger grip 23. The engaging part 22 is so formed as to releasably engage with teeth of the setting frame engaging portion 14. The other engaging portion 21 is rotatably fitted in the engaging portion 17 of the setting frame lock 18 such that it will not easily come off.

Figure 12:
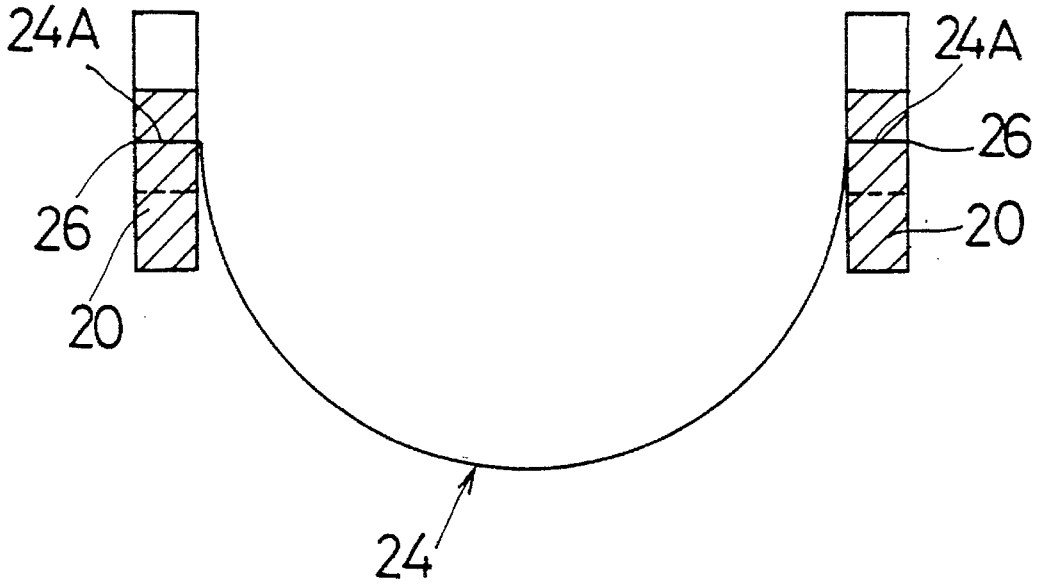
FIG. 12 is a sectional view showing the process for manufacturing the setting frame.
Figure 13:
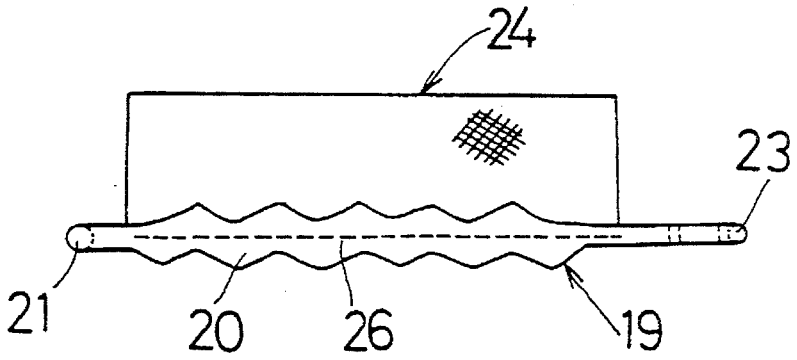
FIG. 13 is a front view showing the process for manufacturing the setting frame.

A reference numeral 24 is a cover made of a net-like flexible material of knitted yarn, which is constituted of a polyester resin which fuses at a higher fusion temperature than the material of the setting frame 19. Either end 24A of the cover 24 is fixedly embedded by insert molding in the pair of clasps 20 of the setting frame 19 as shown in FIG. 12, covering generally the whole circumference of about a half of the outside surface of the roller 11. Therefore, the cover 24 is reversible without changing the shape and size thereof as indicated by a solid line and an alternate long and two short dashes line in FIG. 8. That is, either side of the cover 24 is usable on the roller 11 side.

Both ends 24A of the cover 24 are embedded in the direction of thickness relative to the clasp 20; its inner side protrudes inwardly in the direction of thickness from about the center in the direction of width of the inside surface facing a pair of clasps 20; and the outer edge of either embedded end 24A of the cover 24 is exposed out of the outside surface of the pair of clasps 20, serving as a mark 26 for making certain that the outer edge of either end 24A is fixedly embedded in the pair of clasps 20.

The cover 24 is produced of a flexible, elastic material, and may be an extensible cloth or the like, and furthermore may be constituted of a natural, synthetic, metal, carbon or other inorganic or organic fiber.

Figure 10:
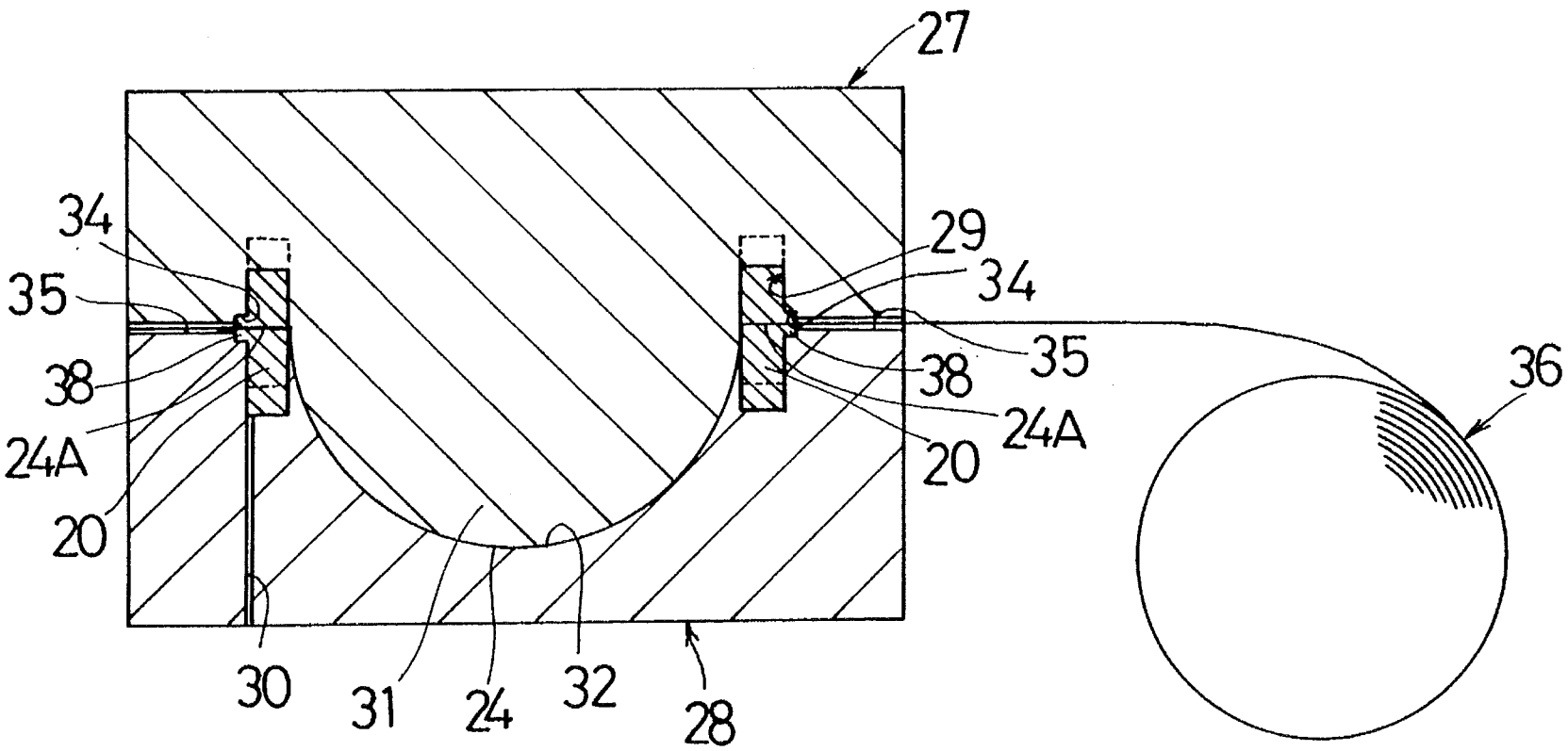
FIG. 10 is a sectional view showing the process for manufacturing the setting frame.
Figure 14:
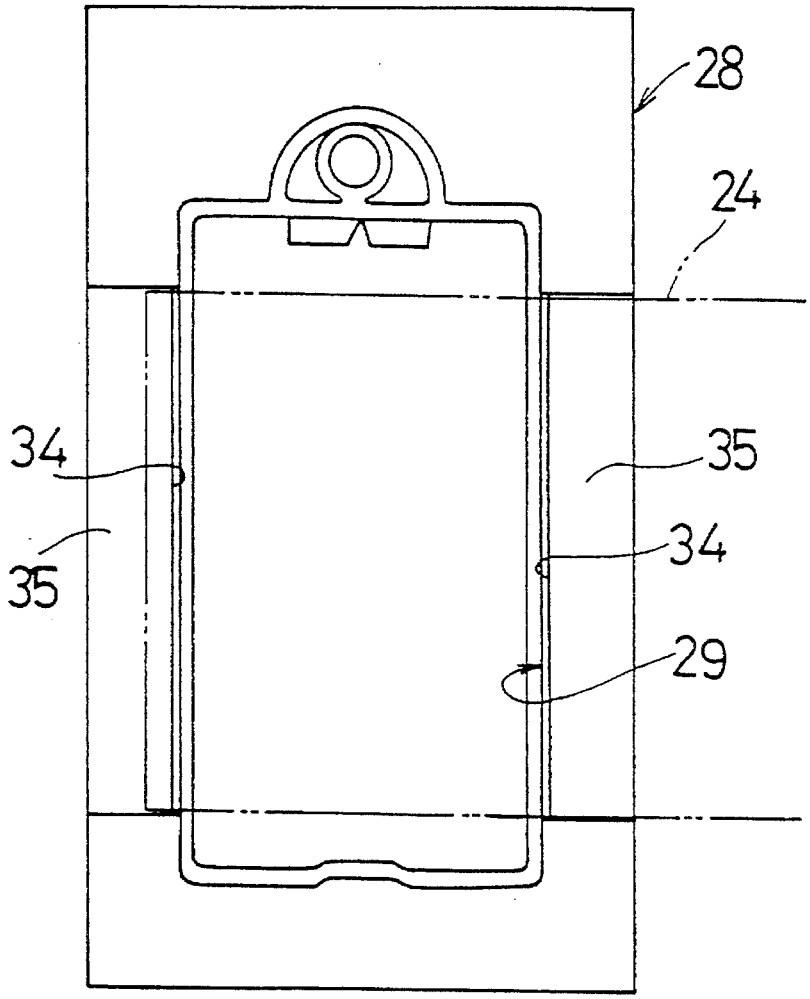
FIG. 14 is a plan view of one of molds shown in FIG. 9.
Figure 15:
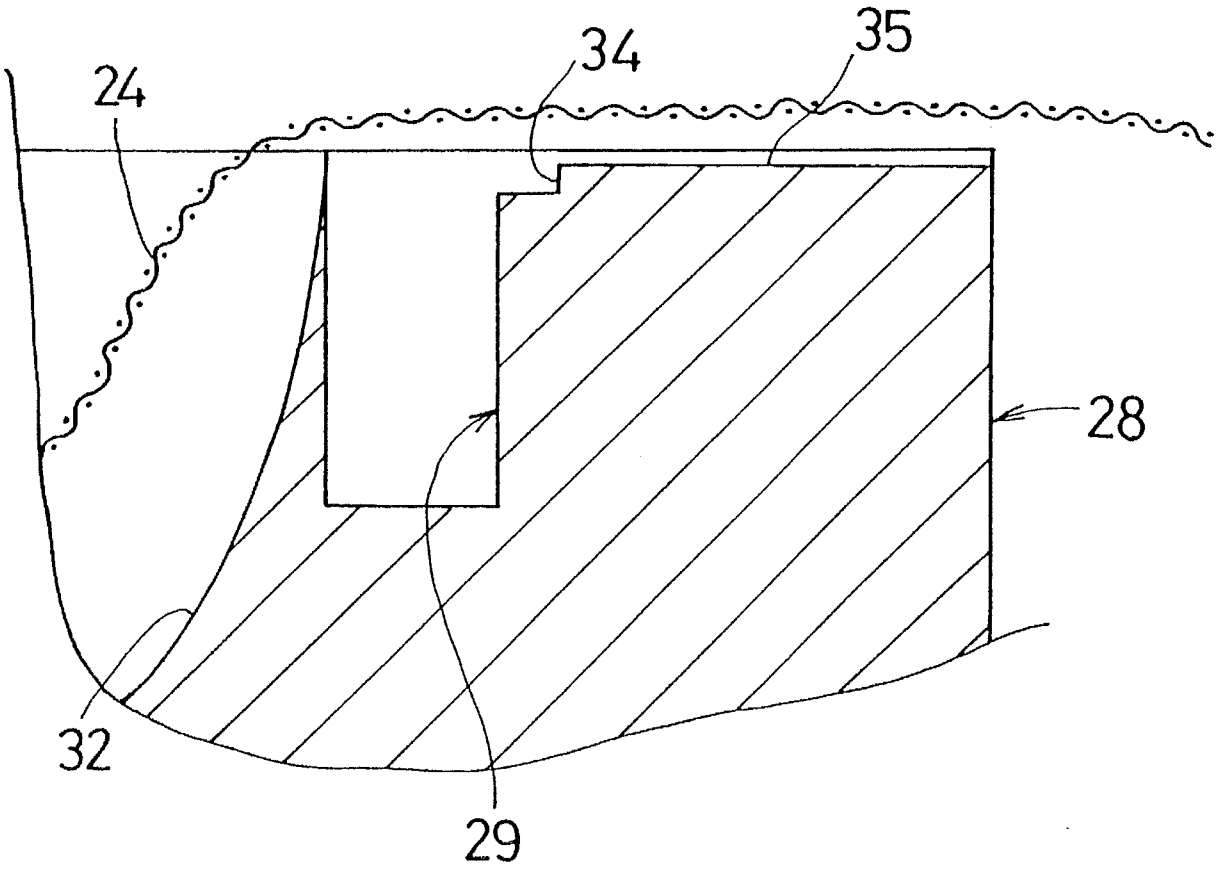
FIG. 15 is an enlarged sectional view of one of the molds shown in FIG. 9.
Figure 16:
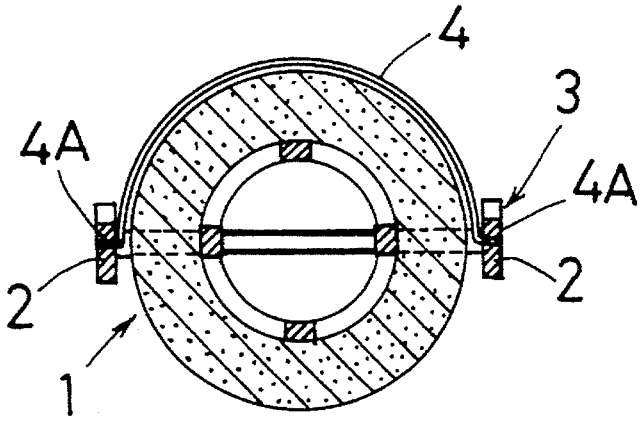
FIG. 16 (PRIOR ART)
FIG. 16 is a sectional view showing a conventional example.
Figure 17:
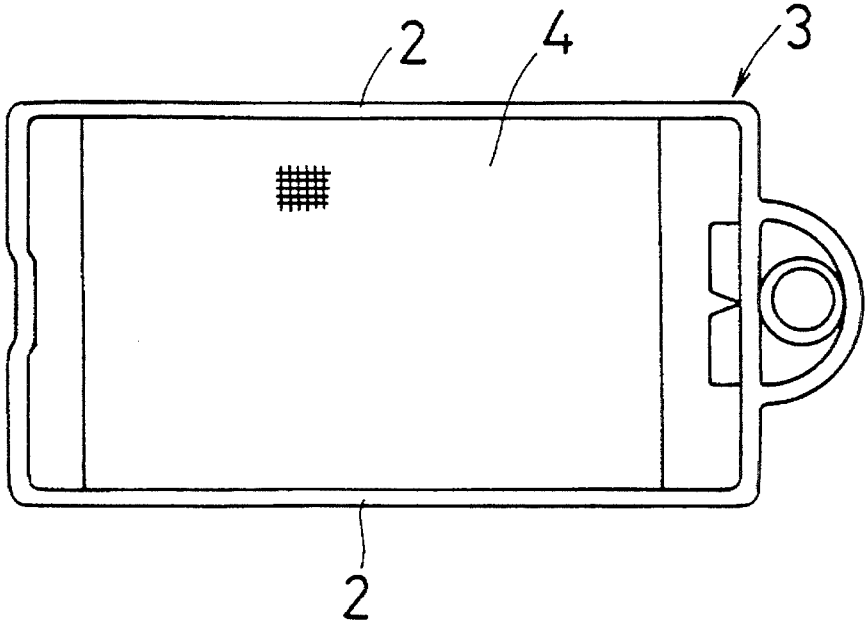
FIG. 17 (PRIOR ART)
FIG. 17 is a plan view of a setting frame fixedly attached with a cover shown in the conventional example.
Figure 18:
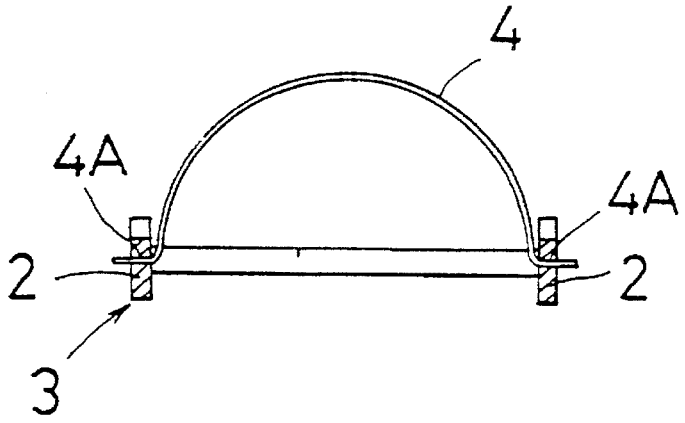
FIG. 18 (PRIOR ART)
FIG. 18 is a sectional view of the setting frame showing the conventional example.

Next, a method of manufacturing the setting frame 19 of the hair curler will be explained. The setting frame 19, as shown in FIG. 10, is manufactured by charging a molten synthetic-resin molding material under pressure into a cavity 29 defined between molds 27 and 28 through a runner 30, and by taking a molded product out of the cavity 29. The mold 27 is provided with a semi-circular projecting portion 31, while the other mold 28 has a recess 32 with which the projecting portion 31 engages. Between the molds 27 and 28 is provided a projecting part molding recess 34 for molding a projecting portion 33 en bloc described later, in the pair of clasps 20 as shown in FIG. 14 and 15; and further between the molds 27 and 28 is provided an insertion recess 35 for inserting and holding the cover 24. The insertion recess 35 is used, in insert molding, for holding the cover 24 under pressure between the molds 27 and 28 and forming a gap between the molds 27 and 28 narrow enough to prevent the run-off of molten resin through the projecting portion molding recess 34.

Figure 9:
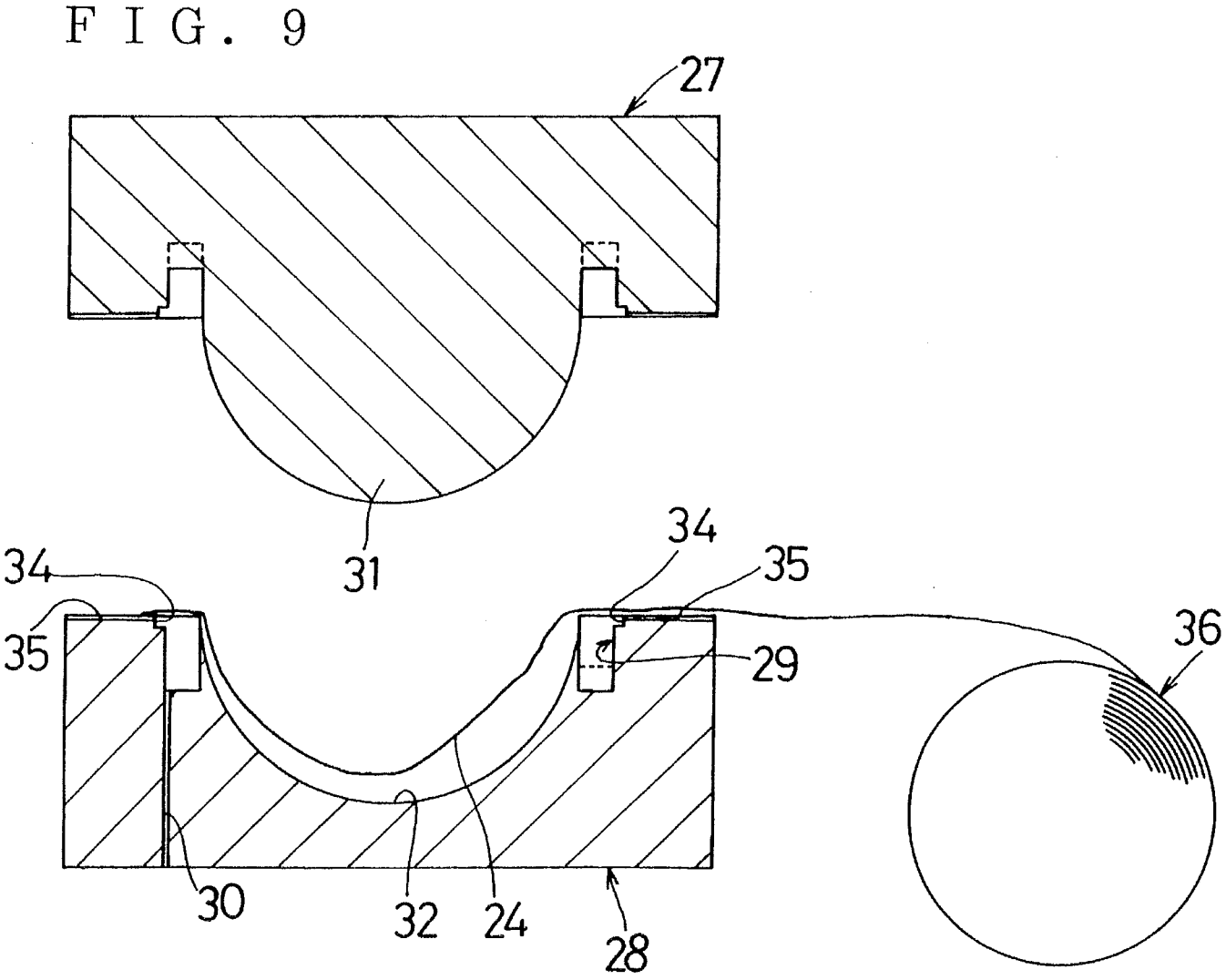
FIG. 9 is a sectional view showing a process for manufacturing the setting frame.
Figure 11:
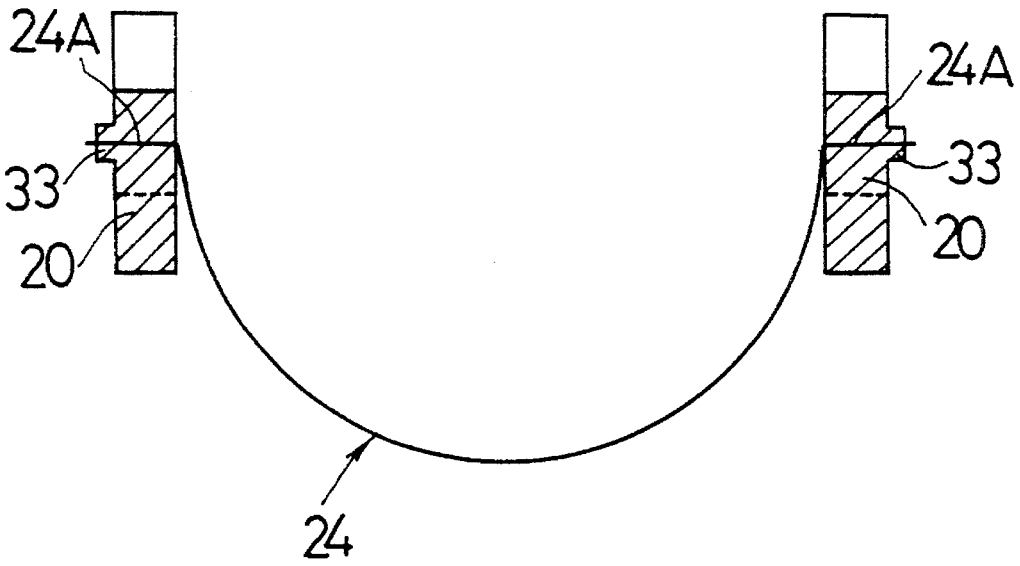
FIG. 11 is a sectional view showing the process for manufacturing the setting frame.

In molding the setting frame 19, a cover material 36 for forming the cover 24 is fed out into the insertion recess 35 such that the cover material 36 will pass through inside the cavity 29 between the molds 27 and 28 as shown for example in FIG. 9; the leading end of the cover material 36 is retained on one mold 28; and thereafter the cover material 36 is fed out under pressure in a circular form into the recess 32 of the mold 28. With the cover 24 preset in the molds 27 and 28 in this manner, the setting frame 19 is molded by insert molding. By this insert molding, the projecting portion 33 with the outer edge side of the cover 24 embedded therein is formed integral with the outside surface of the pair of clasps 20 as shown in FIG. 11. Next, as shown in FIG. 12, the projecting portion 33 is cut off the pair of clasps 20 together with the outer edge side of the cover 24 embedded in the projecting portion 33. Therefore it is possible to easily cut off, together with the projecting portion 33, the outer edge side of either end 24A of the cover 24 outwardly protruding from the outside surface of the clasp 20. At this time, the outer edge of either end 24A is exposed out of the outside surface of the pair of clasps 20; this exposed portion serves as a mark 26 for ascertaining that both ends 24A of the cover 24 are fixedly embedded in the pair of claps 20.

In the embodiment described above, when the hair curler in an assembled state shown in FIGS. 1 to 6 is to be used in curling the hair, first the finger grip 23 of the setting frame 19 is gripped with finger tips and pulled axially outwardly, so that the setting frame 19 will extend with elastic deformation until the engaging part 22 comes off from the engaging part 14. In this state, the setting frame 19 is pulled in a radial direction, and turned over on the center of the other engaging part 21 until the setting frame 19 comes in series with the roller 11. Then, the setting frame 19 is held together with the roller 11 by one hand; and the roller 11 is lightly pressed against the hair, and then rolled to wind a strand of hair on the roller 11. After the strand of hair has been thus wound, the setting frame 19 is turned over on the center of the engaging part 21 to the engaging part 14 and then the finger grip 23 of the engaging lug 22A is positioned on the center axis of the core cylinder 12 of the roller 11, with the finger grip 23 of the engaging part 22 left in an as-pulled out state, thereby fitting the engaging part 22 in the engaging part 14. At this time, the hair that has been wound on the roller 11 is held from both sides between the roller 22 and the clasp 20 of the setting frame 19. Therefore, even when the hair has been gradation-cut, there is no fear that the hair will appear radially outwardly of the roller 11; that is, the state of hair wound on the roller 11 can be reliably and satisfactorily held.

Since either side of the cover 24 is usable in the same condition on the roller 11, pressing a strand of hair smoothly against the outer skin part 13 of the roller 11 and easily engaging the setting frame 19 with the engaging part 14 of the roller 11. Furthermore, the cover 24, being flexible and elastic, and moreover being fixedly embedded in the central portion of the inside surface facing the clasp 20, is smoothly usable without impairing the hair. Furthermore, the setting frame 19, designed to allow rotation of the roller 11, insures easy and efficient winding of the hair on the roller 11.

What we claim is:

1. A hair curler comprising a roller and a rectangular frame-like setting frame having a pair of clasps respectively disposed on first and second sides of said setting frame for radially holding said roller from both of said first and second sides, said setting frame being releasably engaged in an axial direction with either end of said roller and provided with a flexible cover covering at least part of an entire length of about a half of an outer periphery of said roller between said clasps, said cover including first and second ends which are each fixedly embedded by insert molding in a respective one of said pair of clasps of said setting frame, wherein:

each of said clasps include an outer cut surface portion at a location at which said first and second ends of said cover are respectively embedded thereby providing respective exposed first and second outer edges of said first and second ends of said cover at said outer cut surface portions, with said first and second outer edges each fixedly embedded in a respective one of said pair of clasps.

2. A hair curler as defined in claim 1, wherein said cover is produced of a net-like flexible material of knitted yarn.

3. A hair curler as defined in claim 1, wherein said cover is constituted of a material which is fusible at a higher fusion temperature than a component material of said setting frame.

4. A hair curler as defined in claim 1, wherein both of said first and second ends of said cover are embedded to extend in a thickness direction of each of said clasps, with said thickness direction corresponding to a radial direction of said roller, with each of said first and second ends protruding inwardly in the thickness direction from a center of an inside surface of each of said clasps, with said inside surface corresponding to a surface of each of said clasps which faces toward said roller, and with said center being the center with respect to a width direction of each of said clasps, with said width direction substantially orthogonal to said thickness direction.

5. A method of manufacturing a hair curler comprising a roller, and a rectangular frame-like setting frame with a pair of clasps respectively disposed on first and second sides of said setting frame for holding said roller radially from both of said first and second sides, said setting frame being releasably engaged with either end of said roller in the axial direction of said roller, the hair curler including a flexible cover provided for covering at least part of an entire length of about a half of an outer periphery of said roller between said clasps, and said cover including first and second ends each fixedly embedded by insert molding in a respective one of said pair of clasps of said setting frame, the method including:

integrally forming a projecting portion with an outer edge side of each of said first and second ends of said cover embedded in an outer side surface of a respective one of said pair of clasps, and thereafter cutting said projecting portion from said pair of clasps together with the outer edge side of each of said first and second ends of said cover embedded in said projecting portion.

6. A method of manufacturing a hair curler as defined in claim 5, wherein said cover is produced of a net-like flexible material of knitted yarn.

7. A method of manufacturing a hair curler as defined in claim 5, wherein said cover is constituted of a material which fuses at a higher fusing temperature than the component material of said setting frame.

8. A method of manufacturing a hair curler as defined in claim 5, wherein both of said first and second ends of said cover are embedded to extend in a thickness direction of each of said clasps; and each of said first and second ends protrudes inwardly in the thickness direction from a center of an inside surface of each of said clasps, with said inside surface corresponding to a surface of each of said clasps which faces toward said roller, and with said center being the center with respect to a width direction of each of said clasps, with said width direction substantially orthogonal to said thickness direction.

9. A method of manufacturing a hair curler as defined in claim 5, wherein said setting frame of said hair curler is manufactured by charging a molten synthetic-resin molding material under pressure into a cavity defined between molds through a runner, and by taking a molded product out of said cavity.

10. A method of manufacturing a hair curler as defined in claim 9, wherein one mold is provided with a semi-circular projecting portion, while the other mold has a recess with which said projecting portion engages; between said molds is provided a projecting part molding recess for molding a projecting portion en bloc in said pair of clasps; and further between said molds is provided an insertion recess for inserting and holding said cover.

11. A method of manufacturing a hair curler as defined in claim 10, wherein said insertion recess is used, in insert molding, for holding said cover under pressure between said molds and forming a gap between said molds narrow enough to prevent the run-off of molten resin through said projecting portion molding recess.

12. A method of manufacturing a hair curler as defined in claim 5, wherein, in molding said setting frame, a cover material for forming said cover is fed into an insertion recess through a cavity located between a pair of molds; with a leading end of said cover material retained on one mold; and thereafter, with said pair of molds engaged with each other, said cover material is fed out under pressure in a circular form.

* * * * *